United States Patent [19]

Frey

[11] 4,377,134

[45] Mar. 22, 1983

[54] STEAM TEMPERATURE CONTROL WITH OVERFIRE AIR FIRING

[75] Inventor: Donald J. Frey, North Canton, Conn.

[73] Assignee: Combustion Engineering, Inc., Windsor, Conn.

[21] Appl. No.: 289,674

[22] Filed: Aug. 3, 1981

[51] Int. Cl.[3] ..... F22G 5/00

[52] U.S. Cl. ..... 122/479 B; 126/351

[58] Field of Search ..... 122/479 R, 479 B, 479 D; 126/351

[56] References Cited

U.S. PATENT DOCUMENTS

| | | | |
|---|---|---|---|
| 2,363,875 | 11/1944 | Kreisinger et al. . | |
| 3,048,131 | 8/1962 | Hardgrove . | |
| 3,171,390 | 3/1965 | Blodgett | 122/479 B |
| 3,182,640 | 5/1965 | Miller | 122/479 B |
| 3,356,075 | 12/1967 | Livingston . | |
| 4,304,196 | 12/1981 | Chadshay et al. | 122/479 B |

*Primary Examiner*—Edward G. Favors

*Attorney, Agent, or Firm*—William W. Habelt

[57] ABSTRACT

Fuel and a first portion of combustion air are introduced into the furnace (10) of a fossil fuel-fired steam generator in a first zone (30) remote from the gas outlet (14) of the furnace. A second portion of the combustion air, termed overfire air, is introduced into the furnace in a second zone (60) spaced from the first zone (30) intermediate the first zone and the gas outlet of the furnace. The outlet temperature of the superheat steam conveyed through the superheater surface (24) is regulated by selectively directing the overfire air introduced into the furnace towards the gas outlet of the furnace to increase the superheat steam outlet temperature and selectively directing the overfire air introduced into the furnace away from the gas outlet of the furnace to decrease the steam superheat outlet temperature.

Further, the formation of oxides of nitrogen during combustion of the fuel in the furnace is controlled by selectively proportioning the air between the first and second portion so as to introduce into the first zone a quantity of air less than the stoichiometric amount required for the fuel introduced thereto and so as to introduce into the second zone a quantity of air sufficient to substantially complete combustion of the fuel within the furnace.

5 Claims, 1 Drawing Figure

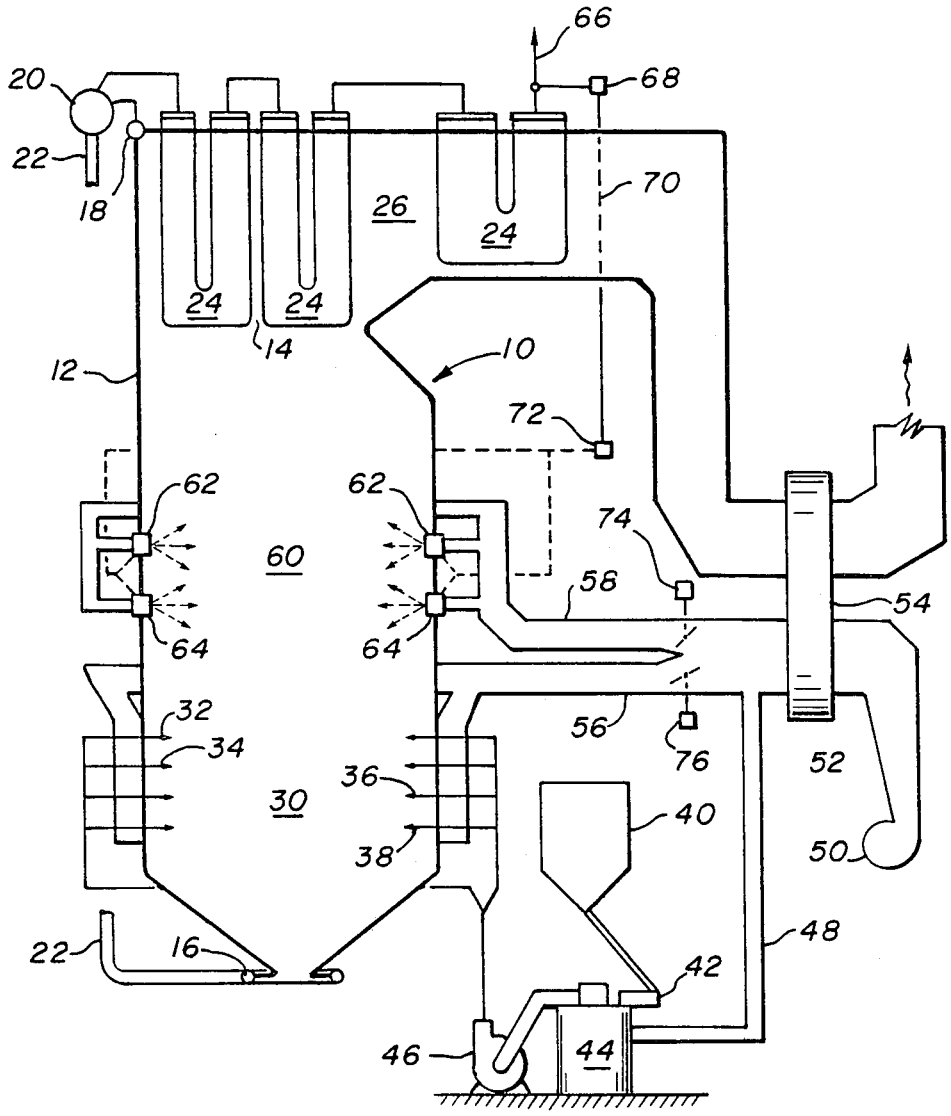
66
68
20
22
18
70
26
24
24
24
14
10
12
72
62
62
74
60
58
54
64
64
32
56
34
76
52
36
30
40
38
50
22
16
48
42
46
44

STEAM TEMPERATURE CONTROL WITH OVERFIRE AIR FIRING

BACKGROUND OF THE INVENTION

The present invention relates generally to the operation of fossil fuel-fired steam generator furnaces and, more particularly, to an improved method of firing a fossil fuel-fired steam generator furnace by means of proportioning the combustion air between a first zone wherein the fuel is emitted and combustion is initiated and a second zone disposed down stream thereof to control the formation of nitrogen oxides within the furnace and by selectively positioning the second zone in relationship to the outlet of the furnace to control superheat steam temperature.

In a typical steam generator, feed water is passed through the furnace walls wherein the water absorbs heat released by the combustion of a fossil fuel within the furnace. As the water flows through the furnace water wall tubes it is raised to saturation temperature and then partially evaporated to form a steam-water mixture. The steam-water mixture is then passed to a drum wherein the water is mixed with makeup water and passed through the furnace waterwalls once again. The steam separated from the water in the drum is superheated by being passed in heat exchange relationship with the gases leaving the furnace through heat exchange surface disposed downstream of the furnace outlet.

In order to yield the desired superheat steam temperature, not only the total heat absorption in the water heating circuit, the evaporative circuit, and the steam superheater be controlled, but also that the ratio of heat absorbed in the water heating on an evaporative circuit to that absorbed in the steam superheater must be control. Although the total amount of heat absorption for a given furnace design can be controlled relatively easily by controlling the amount of fuel-fired in the furnace, controlling the ratio of heat absorption between the water heating and evaporative circuits to the absorption in the steam superheater is somewhat more difficult. Various control methods have been successfully used in the past including steam desuperheating, gas recirculation and burner tilts.

In controlling steam temperature by burner tilt, the combustion zone is physically repositioned within the furnace. To increase superheat steam temperature, the amount of heat absorption in the furnace is decreased by directing the air and fuel entering the furnace upwardly towards the furnance outlet thereby raising the combustion zone within the furnace and positioning the combustion zone closer to the furnace outlet and superheater disposed downstream thereof. To decrease steam superheat steam temperature, the heat absorption in the furnace water walls is increased by directing the fuel and air emitted to the furnace downwardly away from the furnace outlet so as to lower the combustion zone within a furnace and move the combustion zone further away from the furnace outlet and the superheater disposed downstream thereof.

A problem associated with the burner tilt method of controlling steam temperature is that the burner tilt mechanism can become very complicated. This is particularly true with respect to the new low emission burners which have been recently designed for the control of a formation of nitrogen oxides during the combustion process within the furnace. Many of these low emission burners are formed of a multiplicity of concentric ducts so that the air flow being emitted with the fuel in the combustion zone can be positioned selectively about the fuel stream so as to control mixing of the fuel and air upon admission to the furnace.

Additionally, it is well known in the prior art to further control the formation of nitrogen oxides in the combustion process of a fossil fuel-fired furnace by proportioning air flow between a first zone wherein combustion is initiated and a second zone positioned downstream of a first zone and between the first zone and the furnace outlet. In this method of controlling nitrogen oxide formation, commonly referred to as two-stage combustion or overfire air combustion, a first portion of the combustion air is emitted to the first zone in the immediate vicinity to fuel to be burned in an amount less than the theoretical amount of air required for combustion of the emitted fuel, i.e. less than the stoichiometric air requirement, while the remaining combustion air, termed overfire air, is emitted to the furnace in a downstream second zone in order to attain complete combustion of any on burned fuel before the gases leave the furnace outlet.

It is accordingly an object of the present invention to provide an improved method for firing a fossil fuel-fired steam generator wherein control of steam superheat outlet temperature may be readily achieved, and further, to provide such a method wherein control of steam superheat outlet temperature may be achieved in conjunction with the control of nitrogen oxide formation within the furnace in an intergrated control process.

SUMMARY OF THE INVENTION

In a fossil fuel-fired steam generator having an elongated furnace with a gas outlet, steam generating tubes lining the wall of the furnace, a gas exit duct connected to the gas outlet of the furnace for conveying gases therefrom over superheater surface located in the exit duct, and means for conveying steam generated in the steam generating tubes lining the furnace wall through the superheater surface, a method of firing the furnace wherein fuel is injected into the furnace in a first zone remote from the gas outlet of the furnace, a first portion of combustion air is introduced into the first zone to mix with the fuel and initiate combustion of the fuel therein, and a second portion of air is introduced into the furnace in a second zone spaced from the first zone intermediate the first zone and the gas outlet of the furnace.

In accordance with the present invention, the outlet temperature of the superheat steam conveyed through the superheater surface is regulated by selectively directing the second portion of air introduced into the furnace towards the gas outlet of the furnace to increase the superheat steam outlet temperature and selectively directing the second portion of air introduced into the furnace away from the gas outlet of the furnace to decrease the steam superheat outlet temperature.

Further, the formation of oxides of nitrogen during combustion of the fuel in the furnace is controlled by selectively proportioning the air between the first and second portion so as to introduce into the first zone a quantity of air less than the stoichiometric amount required for the fuel introduced thereto and so as to introduce into the second zone a quantity of air sufficient to substantially complete combustion of the fuel within the furnace.

BRIEF DESCRIPTION OF THE DRAWINGS

The single FIGURE of the drawing is a sectional side elevational view, schematic in nature, showing a steam generator designed in accordance with the present invention.

DESCRIPTION OF A PREFERRED EMBODIMENT

Referring now to the drawing, there is depicted therein a fossil fuel-fired steam generator having a vertically elongated furnace 10 formed of upright water walls 12 and a gas outlet 14 located at the upper end thereof. To generate steam, water is passed through the lower water wall inlet header 16 upwardly through the water walls 12 forming the furnace 10. As the water passes upwardly through the water walls 12, it absorbs heat from the combustion of a fossil fuel within the furnace 10 and is first heated to the saturation temperature and then partially evaporated to form a steam-water mixture. The steam-water mixture leaving the water walls 12 is collected in a water wall outlet header 18 and then is passed to drum 20 wherein the water and steam are separated.

The water separated from the steam-water mixture in the drum 20 is mixed with feed water and passed through downcomer 22 back to the lower water wall ring header 16 to be passed therefrom upwardly through the waterwalls 12 once again. The steam removed from the steam-water mixture in the drum 20 is passed through heat exchange surface 24, such as a superheater or reheater, disposed in the gas exit duct 26 connected to the furnace outlet 14 for conveying the gases formed in the furnace to the steam generator stack. In passing through the heat exchange surface 24, the steam is superheated as it is passed in heat exchange relationship with the hot gases leaving the gas outlet 14 of the furnace 10 through the gas exit duct 26.

The furnace 10 is fired by injecting fuel into the furnace in a first zone 30 through several stationary fuel injection ports 32, 34, 36 and 38 located in the lower region of the furnace 10 remote from the gas outlet 14 thereof. The amount of fuel injected into the furnace is controlled to provide the necessary total heat release to yield a desired total heat absorption for a given steam generator design. Although the furnace 10 is shown as a pulverized coal fired furnace in the drawing, the fuel may be oil, natural gas or a combination of any of these fuels. In any event the fuel is injected into the first zone 30 located in the lower region of the furnace 10 remote from the gas outlet 14 for suspension burning therein.

In pulverized coal firing, as shown in the drawing, raw coal is fed from a storage bin 40 at a controlled rate through feeder 42 to an air swept pulverizer 44 wherein the raw coal is comminuted to a fine powder like particle size. Preheated air is drawn by an exhauster fan 46 from the air heater outlet through supply duct 48 and through the pulverizer 44 wherein the comminuted coal is entrained in and dried by the preheated air stream. The pulverized coal and air is then fed to the first zone 30 of the furnace 10 through fuel injection ports, i.e., burners, 32, 34, 36 and 38. The preheated air used in drying the pulverized coal and transporting the coal to the fuel injection ports is typically 10 to 15 percent of the total combustion air. Combustion air is supplied by forced draft fan 50 through air supply duct 52 to an air preheater 54 wherein the combustion air is passed in heat exchange relationship with the gases passing from the furnace through the gas exit duct 26.

In accordance with the present invention, a first portion of the air leaving the air preheater 54 is passed through air duct 56 to the wind box 60 disposed about the fuel injection ports 32, 34, 36, and 38. This first portion air then passes form wind box 60 into the furnace into the first zone 30 wherein combustion of the fuel is initiated. Simultaneously, a second portion of the air leaving the air preheater 54 passes through air duct 58 and is introduced into the furnace 10 into a second zone 60 through overfire air injection ports 62 and 64. The second zone 60, wherein combustion is completed, is spaced from the first zone 30 and located intermediate the first zone 30 and the gas outlet 14 of the furnace 10. The gases formed in the first zone 30 upon partial combustion of the fuel injection therein must traverse the second zone 60 in leaving the furnace 10 through the gas outlet 14. In the second zone 60 any unburned fuel is combusted and any partial products of combustion, such as carbon monoxide, are further oxidized so as to substantially complete combustion before the gases leave the furnace 10 through the furnace gas outlet 14 at the top thereof.

In accordance with the present invention, the outlet temperature of the superheat steam leaving the superheater 24 is regulated by selectively directing the second portion of air introduced into the second zone 60 of the furnace 10 through the overfire air injection ports upwardly toward the gas outlet 14 of the furnace 10 in order to increase steam temperature or downwardly away from the gas outlet 14 of the furnace 10 to decrease steam temperature. Measurement means 66 is provided at the outlet of the superheater surface 24 to measure the temperature of the superheater steam leaving the superheater 24. Comparision means 68 compares the measured superheat outlet temperature sensed by the measuring means 66 to a desired superheat steam temperature set by the operator of the steam generator and establishes a signal 70 indicative of a high or a low superheat steam outlet temperature. Actuator means 72 receives the signal 70 from comparison means 68 and in response thereto actuates a mechanical mechanism to cause nozzle tips associated with the overfire air injection ports 62 and 64 to move upwardly or downwardly so as the deflect the air being emitted into the second zone 60 either upwardly toward the gas outlet 14 of the furnace 10 in response to a signal indicating a low superheat steam outlet temperature or downwardly away from the gas outlet 14 of the furnace 10 in response to a signal indicating a high superheat steam outlet temperature.

If the second portion of air being emitted to the second zone 60 of the furnace 10 is directed upwardly towards the gas outlet 14, the second zone 60 in effect shifts upwardly towards the gas outlet 14. In so doing, the completion of combustion is delayed and moved closer to the gas outlet 14 of the furnace 10 which results in the temperature of the gases leaving the furnace 10 through the gas outlet 14 and subsequent passing over the superheater surface 24 in the gas exit duct 26 to increase. When the gas temperature leaving the furnace 10 increases, the amount of heat absorption by the steam passing through the downsteam superheater surface 24 will also increase thereby raising the superheat steam outlet temperature.

In a similar manner, when the second portion of air emitted into the second zone 60 the furnace is directed downwardly away from the gas outlet 14 thereof, the second zone 60 in effect shifts downward away from the gas outlet 14 towards the first zone 30 and combustion is completed earlier, i.e. combustion is completed further from the gas outlet 14. Thus, the temperature of the gases leaving the furnace 10 through the gas outlet 14 decreases since the gases must traverse more water wall surface after the completion of combustion in reaching the gas outlet 14. As the gas temperature leaving the gas outlet 14 decreases, the absorption of heat by the steam passing through the superheater surface 24 disposed in the gas exit duct 26 will decrease thereby resulting in a lower superheat steam outlet temperature.

The formation of nitrogen oxides within the furnace 10 can be effectively controlled by proportioning air between the first zone 30 and the second zone 60 of the furnace 10 in accordance with well known principals. It is contemplated by the present invention to regulate steam temperature in a manner described above and simultaneously control the formation of oxides of nitrogen during the combustion of the fuel in the furnace 10 by selectively proportioning the air between the first and second portions so as to introduce into the first zone 30 a quantity of air less than the stoichiometric amount for the fuel introduced thereto and to introduce into the second zone 60 a quantity of air sufficient to substantially complete combustion of the fuel introduced into the first zone 30. Additionally, it is contemplated that the fuel injection ports, i.e. burners, 32, 34, 36 and 38, which are now held stationary, are of the type designed to yield low nitrogen oxide formation by controlling the mixing of air and fuel upon emission to the furnace. As mentioned previously, burners of this type are generally of a very complicated design. However, as in accordance with the present invention steam outlet temperature is controlled by selectively directing the second portion of air emitted to the furnace upwardly or downwardly, it is not necessary to provide any means for tilting the burners 32 through 38. Therefore, the more complicated low emission burners can be readily used as they may be held stationary.

In a further aspect of the present invention, the second portion of air introduced into the furnace 10 and the second zone 60 is subdivided into at least two subportions which are introduced into the furnace through a first level of overfire air emission ports 62 and a second level of overfire air emission ports 64 which are located in the walls of the furnace, perferrably at the corners thereof, in spaced relationship from each other and spaced from the first zone 30 intermediate the first zone 30 and the gas outlet 14 of the furnace 10. Thus, it is contemplated in the present invention to provide within the second zone 60 multiple levels of overfire air injection ports, spaced vertically from each other, and located at increasing distances from the first combustion zone 30. This would provide the operator of the steam generator with the flexibility of directing the second portion of air into the furnace selectively through one or more of the levels of overfire air injection ports so as to enable him to optimize control of nitrogen oxide formation and steam temperature at each point over the load range at which the steam generator may operate.

Accordingly, it will be appreciated that applicant has provided an improved method of firing the furnace of a fossil fuel-fired steam generator nitrogen oxide formation and steam temperature can be readily controlled in an integrated system. While the Applicant has illustrated and described herein a preferred embodiment of his invention, it is to be understood that such is merely illustrative and not restrictive and that variations and modifications by those skilled in the art may be made therein without departing from the scope and spirit of the invention as recited in the claims apended hereto.

I claim:

1. In a fossil fuel-fired steam generator having an elongated furnace with a gas outlet, steam generating tubes lining the walls of said furnace, a gas exit duct connected to the gas outlet of said furnace for conveying gases therefrom, superheater surface located in said exit duct, and means for conveying steam generated in said steam generating tubes through said superheat surface in heat exchange relationship with the gases passing through said exit duct; a method of firing said furnace comprising:

a. injecting fuel into said furnace in a first zone remote from the gas outlet of said furnace;

b. introducing a first portion of air into said first zone whereupon combustion of the fuel is initiated;

c. introducing a second portion of air into said furnace in a second zone spaced from said first zone and intermediate said first zone and the gas outlet of said furnace; and d. regulating the outlet temperature of the steam conveyed through said superheat surface by selectively directing the second portion of air introduced into said furnace toward the gas outlet thereof to increase said temperature and away from the gas outlet thereof to decrease said temperature.

2. A method of firing a furnace as recited in claim 1 wherein the step of introducing a second portion of air into the furnace comprises:

a. subdividing the second portion of air into at least two subportions; and b. introducing said subportions into the furnace in spaced relationship from each other intermediate said first zone and the gas outlet of said furnace and spaced from said first zone.

3. A method of firing a furnace as recited in claims 1 or 2 further comprising the step of controlling the formation of oxides of nitrogen during combustion of the fuel in said furnace by selectively proportioning the air between said first and said second portion so as to:

introduce into said first zone a quantity of air less than the stoichiometric amount for the fuel introduced thereto;

and introduce into said second zone a quantity of air sufficient to substantially complete combustion of the fuel introduced into said first zone.

4. In a fossil fuel-fired steam generator having a vertically elongated furnace with a gas outlet at the upper end thereof, steam generating tubes lining the walls of said furnace, a gas exit duct connected to the gas outlet of said furnace for conveying gases therefrom, superheater surface located in said exit duct, and means for conveying steam generated in said steam generating tubes through said superheat surface in heat exchange relationship with the gases passing through said exit duct; a method of firing said furnace comprising:

a. injecting fuel into the lower region of said furnace remote from the gas outlet thereof;

b. introducing a first portion of air into the lower region of said furnace in the immediate vicinity thereof whereupon combustion of the fuel is initiated, said portion of air being a quantity less than the stoichiometric amount for the fuel introduced thereto;

c. introducing a second portion of air into said furnace in an intermediate zone below the gas outlet thereof and above and spaced apart from said first zone, said second portion of air being a quantity sufficient to substantially complete combustion of the fuel introduced into said first zone;

d. measuring the outlet temperature of the steam conveyed through said superheat surface;

e. comparing said measured superheat steam outlet temperature to a desired superheat steam outlet temperature and establishing a signal indicative of a high or a low superheat steam outlet temperature; and f. regulating the outlet temperature of the steam conveyed through said superheat surface by selectively directing said second portion of air into said furnace at a downward angle with the horizontal away from the gas outlet of said furnace in response to a signal indicative of a high superheat steam outlet temperature, and at an upward angle with the horizontal towards the gas outlet of said furnace in response to a signal indicative of a low superheat steam outlet temperature.

5. A fossil fuel-fired steam generator comprising: a vertically elongated furnace; steam generator tubes lining the walls of said furnace; a gas exit duct connected to the gas outlet of said furnace for conveying gases therefrom; superheat surface located in said exit duct; means for conveying steam generated in said steam generating tubes through said superheat surface in heat exchange relationship with the gases passing through said exit duct; stationary firing means for injecting fuel into said furnace in a region remote from the gas outlet of said furnace; first air means for introducing air into said furnace in the immediate vicinity of the fuel; second air means spaced apart from and above said first air means for introducing additional air into said furnace remote from said firing means; means for selectively proportioning the air introduced to said furnace between said first and second air means; means for measuring the outlet temperature of the steam conveyed through said superheat surface; means for comparing said measured superheat steam outlet temperature to a desired superheat steam outlet temperature and establishing a signal indicative of a high or a low superheat steam outlet temperature; and means for selectively directing the air introduced through said second air means into said furnace at a downward angle with the horizontal away from the gas outlet of said furnace in response to a signal indicating a high superheat steam outlet temperature, and at an upward angle with the horizontal towards the gas outlet of said furnace in response to a signal indicating a low superheat steam outlet temperature.

* * * * *